United States Patent [19]

Frey et al.

[11] Patent Number: 4,667,896

[45] Date of Patent: May 26, 1987

[54] THREE FLANGE CABLE SPOOL

[75] Inventors: Rodney R. Frey; Donald L. Obst, both of Hickory, N.C.

[73] Assignee: Siecor Corporation, Hickory, N.C.

[21] Appl. No.: 870,820

[22] Filed: Jun. 5, 1986

[51] Int. Cl.[4] ..... B65H 75/14; B65H 75/18

[52] U.S. Cl. ..... 242/118.41; 242/165; 242/167

[58] Field of Search ..... 242/118.41, 25 R, 7.12, 242/164, 165, 167

[56] References Cited

U.S. PATENT DOCUMENTS

| | | | |
|---|---|---|---|
| 358,705 | 3/1887 | Smith | 242/118.41 |
| 1,909,277 | 5/1933 | Jamar, Jr. | 242/118.41 X |
| 2,340,574 | 2/1944 | Ashworth | 242/118.41 X |
| 3,605,055 | 9/1971 | Grady | 242/118.41 X |
| 4,386,621 | 6/1983 | Redl | 242/118.41 X |

*Primary Examiner*—Stanley N. Gilreath

*Attorney, Agent, or Firm*—Roy B. Moffitt; J. David Abernethy

[57] ABSTRACT

A three flange cable spool having first and second spaced-apart flanges, a tubular-shaped medium portion attached to and disposed between the first and second flanges delimiting a first outside surface between the first and second flanges, a plurality of spokes inside of the medium portion attached to the medium portion, a third flange, spaced apart from either one first or second flange, with a lateral protrusion thereon, a part of the lateral protrusion removably received in the medium portion and another part of the lateral protrusion forming a second outside surface between the third and either the first or second flanges.

7 Claims, 5 Drawing Figures

THREE FLANGE CABLE SPOOL

BACKGROUND OF THE INVENTION

Most wire or cable wound on a two flange spool or reel presents a problem. Both ends of the wire or cable are not readily accessible and thus the wire or cable cannot be easily tested for continuity and other characteristics. In some instances, the entire reel length must be unwound before both reel ends can be reached. To test for continuity and other characteristics, accessibility to both ends is necessary. The prior art teaches the concept of providing a hole in the flange of a reel and threading a short terminal portion of the wire or cable through the hole that would otherwise be covered up by the balance of the wire or cable. This short terminal portion is affixed to the outside surface of one of the two flanges and provides accessibility to both cable reel ends. However, test gear must be taken to the reel or the reel taken to the test gear to take advantage of this accessibility.

To some, this prior art practice is a solution. To others, it is not. In some instances the exposed short length of a terminal portion is not long enough. If a desired length is exposed, it is so long that it is usually damaged in transit. What was needed was a device that would create a three-flange reel out of an existing two-flange reel plus a hole in one of the flanges in the original two-flange reel. Using such a device, a part of the terminal portion of a length of the wire or cable is threaded through the hole in the flange and wound on that part of the reel between the third and first or second flange. The balance of the wire and cable is wound on the reel between the first and second flanges. In this manner, the purchaser of wire and cable on such a three-flange reel spools off a desired length of cable or wire from both reel ends to reach any location of test gear, making it unnecessary to bring the test gear to the reel, or the reel to the test gear. After testing, the wire or cable can be readily respooled.

BRIEF SUMMARY OF THE INVENTION

The invention is a simple one comprising a reel having first, second and third flanges. The third flange is removable. This three-flange reel is made up basically of two parts: the first part is a prior art two-flange reel and the second part is a flange with a lateral protrusion adapted to be removably received in a medium portion of the prior art reel. When both of these elements are put together, a three flange reel is created having a first and second spaced-apart flanges, a tubular shaped medium portion having an internal opening in which a plurality of spokes are disposed attached to and disposed between the first and second flanges, a third flange spaced apart from either the first or second flange with a lateral protrusion thereon. A part of the lateral protrusion is removably received in the medium portion and another part of the lateral protrusion forms a surface between the third and either the first or second flanges. Either one of the first or second flanges has an aperture in it that communicates with a space delimited by the third flange and either the first or second flange. That portion of the lateral protrusion removably received in the medium portion is a tubular shaped body having in it a plurality of longitudinally disposed slots in which the spokes in the internal opening of the tubular medium portion are slideably received. Furthermore, the lateral protrusion has first and second outside diameters delimiting first and second portions, the outside diameter of the first portion being such that it is slideably and removably received within the medium portion. The outside diameter of the second portion is substantially equal to the outside diameter of the medium portion.

The terms "reel" and "spool" and "wire" and "cable" are used interchangeably in this disclosure.

DETAILED DESCRIPTION OF THE INVENTION

Figure 1:
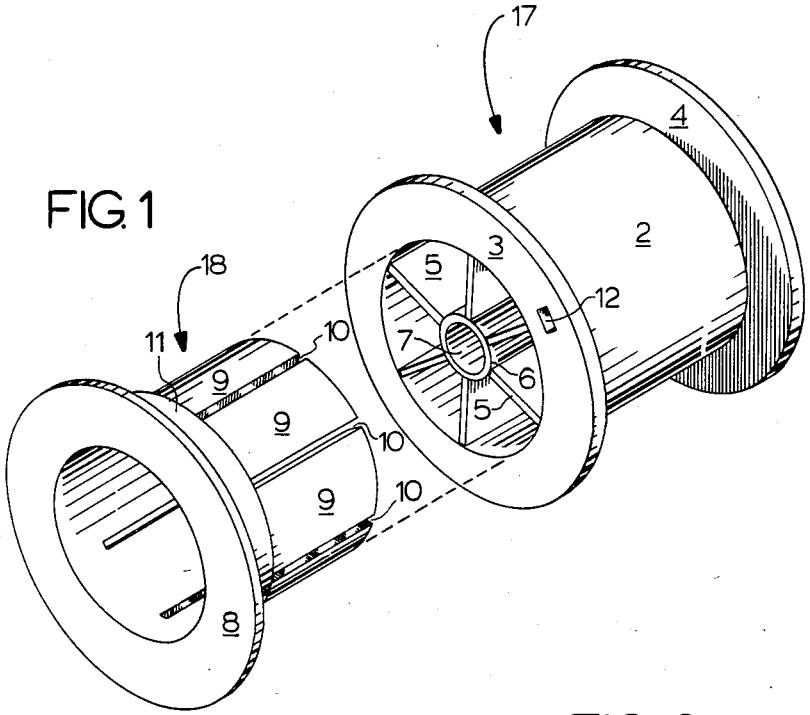
FIG. 1 is an exploded perspective view of the two parts of the invention.

The invention is composed of two parts, elements 17 and 18. Element 17 is a conventional two-flange reel comprising a medium portion 2 disposed in between two spaced-apart flanges 3 and 4. Flange 3 has an aperture 12 in it that communicates with the space partially delimited by flanges 3 and 4 and medium portion 2. Medium portion 2 is tubular in shape, has an internal opening in it in which there is disposed hub 6. Hub 6, which also has an aperture in it, is connected to the interior surface of medium portion 2 by means of spokes 5. Another part of the invention is element 18. This component is composed of flange 8 and lateral protrusions 9 and 11. Lateral protrusion 9 has a plurality of slots 10 in it and is connected to lateral protrusion 11. Lateral protrusion 11 is connected to flange 8 and may have a diameter larger than that of lateral protrusion 9.

Figure 2:
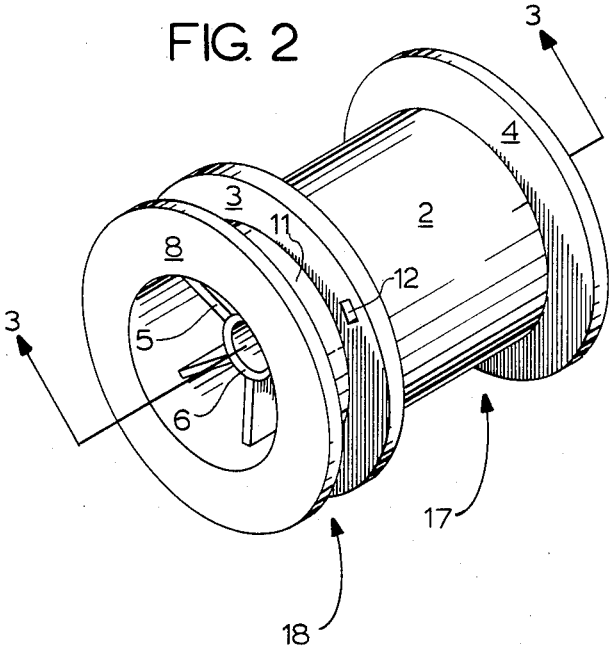
FIG. 2 is a perspective view of the two parts of the invention assembled in their intended combination.

In FIG. 2, there is shown element 18 combined with element 17. Lateral protrusions 9 are of a dimension that they are slideably receivable inside of tubular medium portion 2. Slots 10 are so positioned so that spokes 5 are received in them. Viewing FIG. 3, it can be readily noted that the outside diameter of lateral protrusion 9 is less than the outside member of lateral protrusion 11. Lateral protrusion 9 is adapted to fit within the tubular medium portion 2 of element 17. The outside diameter of lateral protrusion 11 is essentially coextensive with the outside diameter of the tubular shaped medium portion 2. When elements 17 and 18 are combined, the combination of FIGS. 2 and 3 are achieved, a three-flanged reel.

Figure 3:
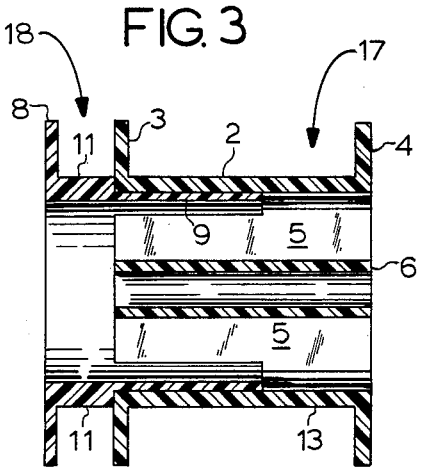
FIG. 3 is a cross-sectional view of the assembled invention along line 3—3.
Figure 4:
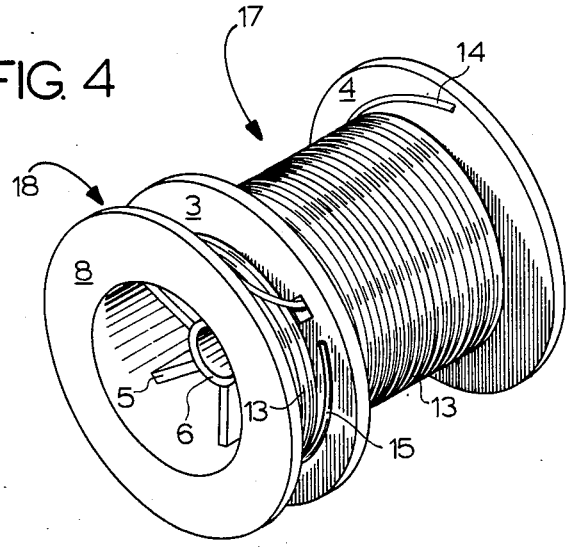
FIG. 4 is a perspective view of the invention with elongated fiber optic cable wrapped thereon.
Figure 5:
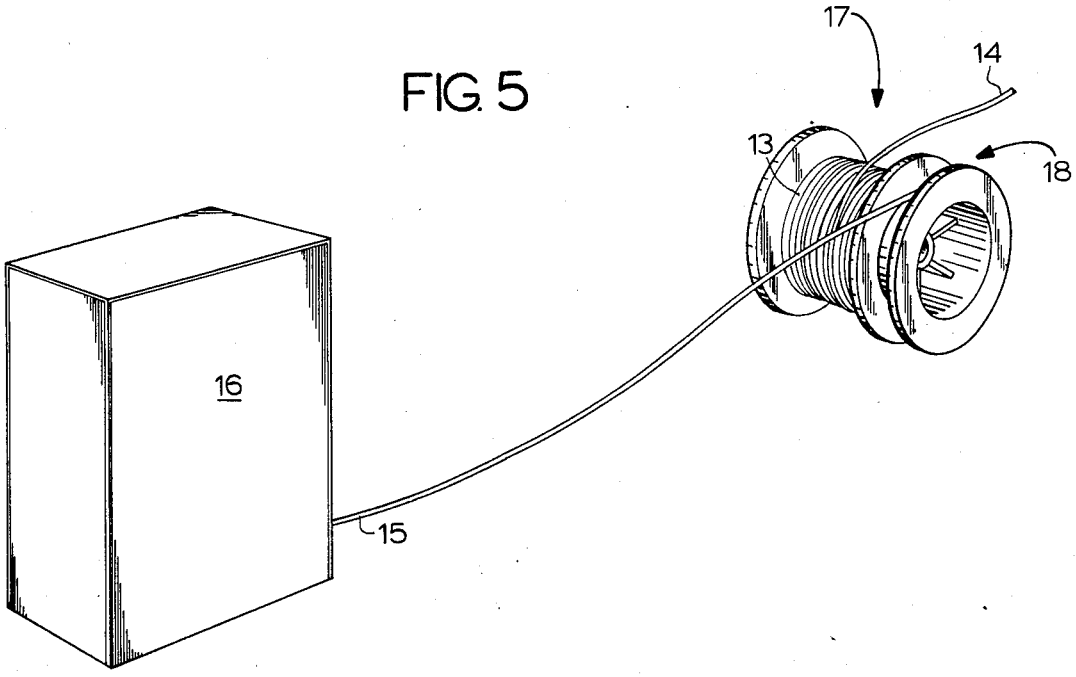
FIG. 5 is a perspective reel of the invention used in combination with a testing machine.

On the three-flanged reel, as described in FIGS. 2 and 3, wire, optical fiber or cable ean be readily wound. A terminal portion of the optical fiber sought to be spooled is threaded through aperture 12, a desired length is pulled through and then wound on lateral protrusion 11. The balance (the bulk) of the cable or optical fiber 13 is then wound on tubular medium portion 2. Wound optical fiber 13 now has both terminal portions exposed, note elements 15 and 14. It is now possible to unwind a desired length of cable or optical fiber from the space partially delimited by flanges 8 and 3 and element 11 and then take the cable to a testing device 16. In like manner, a length of cable or fiber 13 can be unwound from the space partially delimited by flanges 3 and 4 and taken to another station, or to the same testing device 16. Such a practice is schematically shown in FIG. 5. By using a reel of this configuration, test gear need not be brought to the cable reel, nor the cable reel be brought to the test gear. The cable itself can be unwound and bought to the test gear, making it unnecessary to move or disturb sensitively calibrated testing devices by moving them.

Reels such as that shown by element 17 are commonly available and can be converted into a three-flange reel by simply inserting element 18 into the medium portion 2 of element 17 to form the invention. On the other hand, once the need for a three-flange reel has been exhausted, the element 18 can be removed, recreating the original two-flange reel. A combination of 17 and 18 as shown in FIG. 2 permits easy mounting and spooling on existing machinery and generally does not require modification of presently-existing spooling equipment.

We claim:

1. A reel, comprising:

(a) a tubular member having external and internal surfaces, a hub nested therein, spokes connecting the hub and the internal surface of the tubular member, and first and second flanges attached to opposite ends of the tubular member; the hub, adjacent spokes, and the internal surface of the tubular member delimiting a plurality of cavities; and, (b) an attachment having a middle tubular member, a third flange mounted on one end of the middle tubular member, and a plurality of lateral protrusions mounted on the other end of the middle tubular member, wherein at least one lateral protrusion is slideably and removably received in one of the cavities and at least one other protrusion is slideably and removably received in another of the cavities.

2. A reel as recited in claim 1, wherein the first flange has an aperture therein, whereby a strand of flexible material may be wound around the external surface area of the tubular member and a free end of the flexible material may be carried through the aperture and wound about the attachment middle tubular member.

3. A reel as recited in claim 2, wherein the outer diameter of the attachment middle tubular member is substantially the same as the outer diameter of the tubular member.

4. A reel, comprising:

(a) a central member, first and second flanges mounted on opposite ends of the central member, and a plurality of cavities in the central member; and, (b) an attachment having a third flange and a lateral protrusion mounted on one side of the third flange, wherein a portion of the lateral protrusion is received in at least two of the cavities and another portion of the lateral protrusion separates the first flange and the third flange, and wherein the central member has an inner surface, an inner hub and a plurality of spokes mounted between the hub and the inner surface of the central member, the cavities being delimited by the hub, adjacent spokes and the inner surface of the central member.

5. A reel as recited in claim 4 wherein the first flange has an aperture therein.

6. A reel having first and second spaced apart flanges, a tubular shaped median portion having an internal opening attached to and disposed between the first and second flanges, the tubular shaped median portion having a first outside surface between the first and second flanges, a third flange spaced apart from either the first or second flange, having a lateral protrusion thereon, the lateral protrusion comprising a tubular shaped body having in it a plurality of longitudinally disposed slots, a part of said lateral protrusion removably received in the internal opening of the median tubular portion and another part of the lateral protrusion forming a second outside surface between the third and either the first or second flanges, a plurality of spokes in the internal opening of the tubular median portion, said spokes being slideably received in the longitudinally disposed slots of said lateral protrusion.

7. The reel of claim 6 wherein the lateral protrusion has first and second outside diameters delimiting first and second portions, the outside diameter of the first portion being smaller than the second portion and the outside diameter of the second portion being substantially equal to the outside diameter of the median portion.

* * * * *